US007972179B2

(12) United States Patent
Inoue

(10) Patent No.: US 7,972,179 B2
(45) Date of Patent: Jul. 5, 2011

(54) CONTACT TERMINAL AND CONNECTOR

(75) Inventor: Katsuhiro Inoue, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/783,986

(22) Filed: May 20, 2010

(65) Prior Publication Data

US 2010/0304612 A1 Dec. 2, 2010

(30) Foreign Application Priority Data

Jun. 2, 2009 (JP) ..... 2009-133366

(51) Int. Cl.
*H01R 24/00* (2011.01)

(52) U.S. Cl. ..... 439/637

(58) Field of Classification Search ..... 439/637, 439/17, 387
See application file for complete search history.

(56) References Cited

U.S. PATENT DOCUMENTS

| | | | | |
|---|---|---|---|---|
| 3,848,223 | A * | 11/1974 | Pechard | 439/637 |
| 4,119,357 | A * | 10/1978 | Bonhomme | 439/260 |
| 4,157,857 | A * | 6/1979 | Sabo | 439/637 |
| 4,605,896 | A * | 8/1986 | Obrecht | 324/756.05 |
| 5,197,887 | A * | 3/1993 | Davidge et al. | 439/60 |
| 5,428,213 | A * | 6/1995 | Kurihara | 235/475 |
| 5,511,985 | A * | 4/1996 | Noschese et al. | 439/157 |
| 5,606,159 | A * | 2/1997 | Kurihara | 235/438 |
| 6,116,917 | A * | 9/2000 | Choy | 439/79 |
| 6,344,753 | B1 * | 2/2002 | Takada et al. | 324/756.02 |
| 6,419,503 | B1 * | 7/2002 | Choy | 439/79 |
| 6,540,540 | B1 * | 4/2003 | Tobey | 439/327 |
| 6,663,406 | B1 * | 12/2003 | Wu | 439/326 |
| 6,857,908 | B2 * | 2/2005 | Burmeister | 439/632 |
| 6,918,778 | B2 * | 7/2005 | Ruckerbauer et al. | 439/260 |
| 7,473,140 | B2 * | 1/2009 | Guan et al. | 439/637 |
| 7,845,986 | B2 * | 12/2010 | Yasumura et al. | 439/637 |
| 2008/0057792 | A1 * | 3/2008 | Guan et al. | 439/637 |
| 2008/0070446 | A1 * | 3/2008 | Lauermann et al. | 439/626 |
| 2008/0153357 | A1 * | 6/2008 | Hajok et al. | 439/626 |
| 2008/0214053 | A1 * | 9/2008 | Hohne et al. | 439/626 |
| 2009/0068897 | A1 * | 3/2009 | Jin | 439/637 |

FOREIGN PATENT DOCUMENTS

| | | | |
|---|---|---|---|
| JP | 10-92512 | A | 4/1998 |
| JP | 2005-32616 | A | 2/2005 |
| JP | 2006-58129 | A | 3/2006 |

* cited by examiner

*Primary Examiner* — T C Patel
*Assistant Examiner* — Vladimir Imas
(74) *Attorney, Agent, or Firm* — Fujitsu Patent Center

(57) ABSTRACT

A contact terminal for coming into electric contact with a mating terminal of a mating component, the contact terminal includes a rotating member including protrusions on the surface, the rotating member rotates with an advance of the mating terminal, and a spring member that rotatably supports the rotating member and asserts the rotating member against the advancing mating terminal.

6 Claims, 8 Drawing Sheets

CONTACT TERMINAL AND CONNECTOR

CROSS-REFERENCE TO RELATED APPLICATION

This application is based upon and claims the benefit of priority of the prior Japanese Patent Application No. 2009-133366, filed on Jun. 2, 2009, the entire contents of which are incorporated herein by reference.

FIELD

The embodiments discussed herein are related to a contact terminal and a connecter.

BACKGROUND

There is known a card edge connector into which an edge of a printed circuit board is inserted and that includes a contact terminal that comes into contact with a contact terminal formed on the edge of the printed circuit board, thereby establishing electrical continuity therewith. During the soldering of electronic components on a printed circuit board, solder flux is sometimes scattered. If the scattered solder flux is attached to a contact terminal formed on an edge of the printed circuit board, contact failure may occur when the edge is inserted into the card edge connector.

For such a contact terminal, various terminal structures that are less likely to cause contact failure have been proposed. In particular, there has been proposed a structure that facilitates the removal and insertion while help preventing contact failure by using a rotating body, such as a roller or a ball, which rotates with the advance of a mating terminal.

The use of such a contact terminal facilitates the removal and insertion even if the contact pressure is high. By increasing the contact pressure, contact failure may be prevented.

In a case where foreign matter such as solder flux is attached to a mating terminal as described above and a roller is used, the roller merely presses the foreign matter against the mating terminal, and contact failure may not be resolved. On the contrary, the use of the roller may increase contact failure.

The followings are several documents that disclose a connector.

[Patent Document 1] Japanese Laid-open Patent Publication No. 10-92512

[Patent Document 2] Japanese Laid-open Patent Publication No. 2005-32616

[Patent Document 3] Japanese Laid-open Patent Publication No. 2006-58129

SUMMARY

According to an aspect of the embodiment, a contact terminal for coming into electric contact with a mating terminal of a mating component, the contact terminal includes a rotating member including protrusions on the surface, the rotating member rotates with an advance of the mating terminal, and a spring member that rotatably supports the rotating member and asserts the rotating member against the advancing mating terminal.

According to an another aspect of the embodiment, a connector includes a contact terminal that comes into electric contact with a mating terminal of a mating component and includes a rotating member that rotates with an advance of the mating terminal, the rotating member having protrusions on the surface, and a spring member that rotatably supports the rotating member and asserts the rotating member against the advancing mating terminal, and a housing that houses the contact terminal, receives the mating terminal and guides the mating terminal to come into contact with the rotating member.

According to an another aspect of the embodiment, a connector includes a plurality of pairs of contact terminals that each holds a corresponding mating terminal of a mating component therebetween, each of the contact terminals including a rotating member that rotates with an advance of the mating terminal, each of the rotating members having protrusions on the surface, and a spring member that rotatably supports the rotating member and asserts the rotating member against the advancing mating terminal, and a housing that houses the plurality of pairs of contact terminals, receives the mating terminals and guides the mating terminals to come into electric contact with each of pairs of the rotating members.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
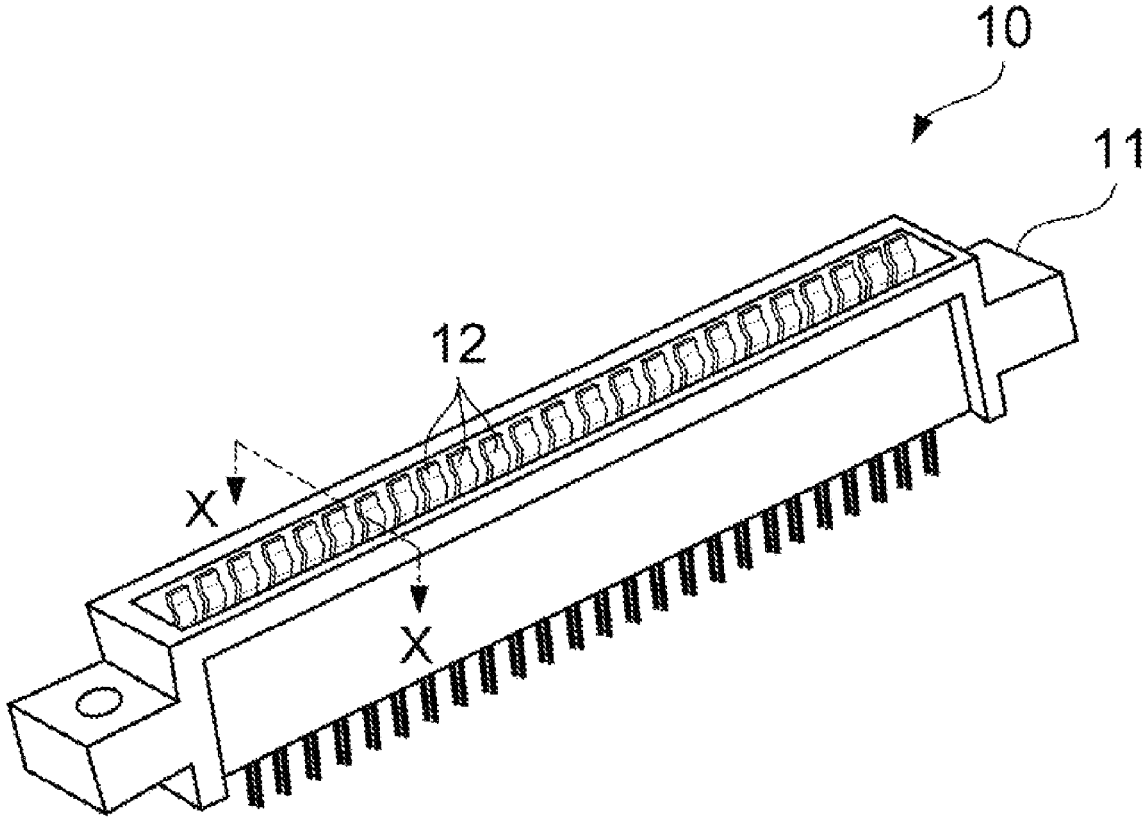
FIG. 1 is a perspective view of a comparative example of a card edge connector.
Figure 2:
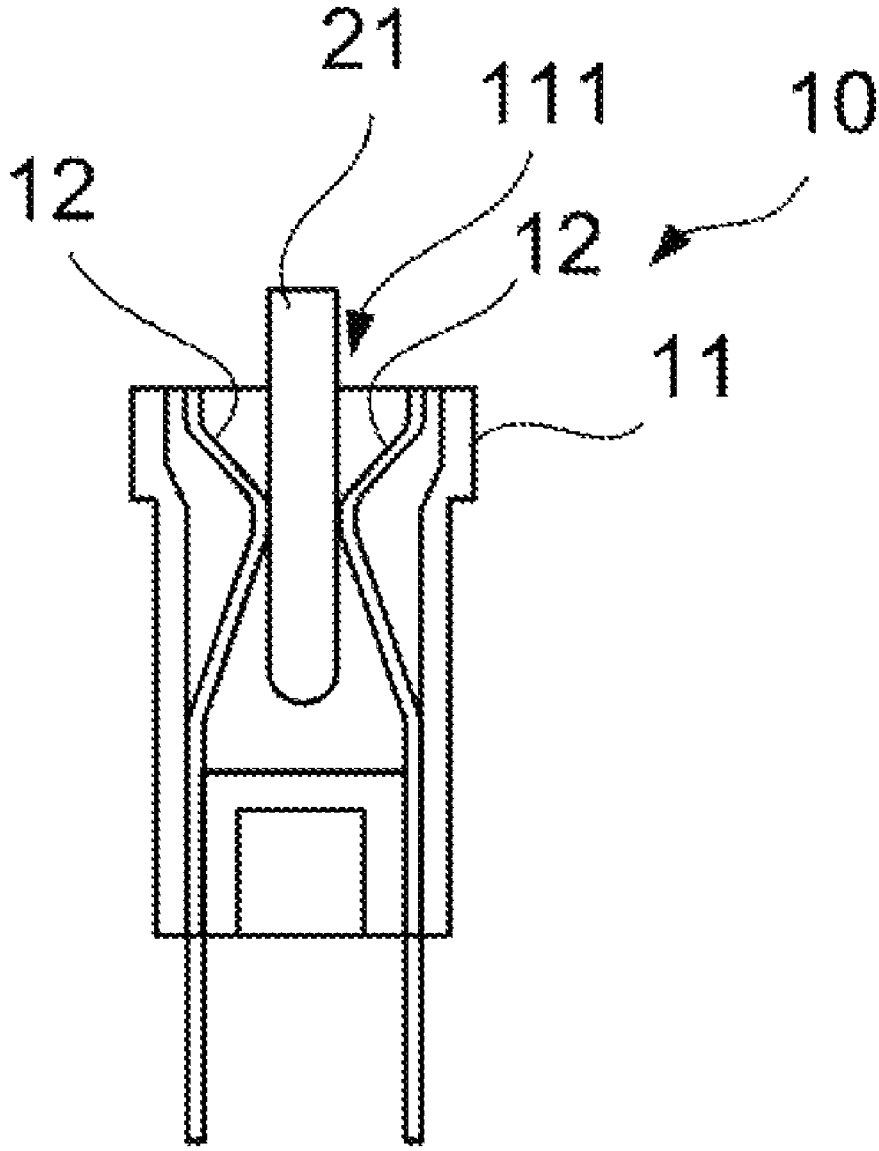
FIG. 2 is a sectional view taken along line X-X of FIG. 1.

Preferred embodiments of the present techniques will be explained with reference to accompanying drawings. First, a comparative example of a card edge connector will be described. FIG. 1 is a perspective view of a card edge connector, and FIG. 2 is a sectional view taken along line X-X of FIG. 1.

The card edge connector 10 includes a housing 11 and a plurality of contact terminals 12 arranged in the housing 11. The housing 11 has an opening 111 formed therein that receives a card edge on which mating terminals 21 are formed. The mating terminals 21 inserted through the opening 111 into the housing 11 are guided by the inner walls of the opening 111 of the housing 11 to a position where the mating terminals 21 come into contact with the contact terminals 12.

Figure 3:
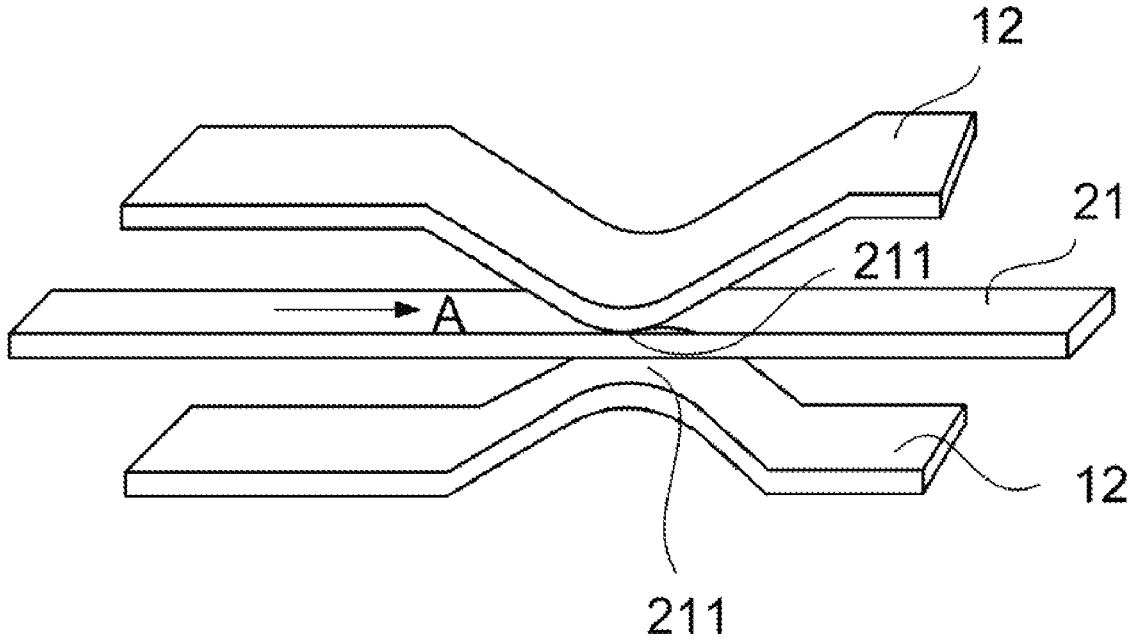
FIG. 3 is a schematic view illustrating the shape of the contact terminals.

FIG. 3 is a schematic view illustrating the shape of the contact terminals. A pair of contact terminals 12 is disposed so as to nip a mating terminal 21 from both sides. Each contact terminal 12 includes a protruding portion 211 that is bent toward the mating terminal 21.

In the case of the pair of contact terminals 12, when the mating terminal 21 is removed or inserted, a large frictional force is generated between the pair of contact terminals 12 and the mating terminal 21. Therefore, if the contact pressure is increased, a larger force is needed to remove or insert a card. If the contact pressure is maintained at a value such that one may remove or insert a card with a moderate force, and if foreign matter such as a resin film is attached to the mating terminal 21, contact failure may occur.

Figure 4:
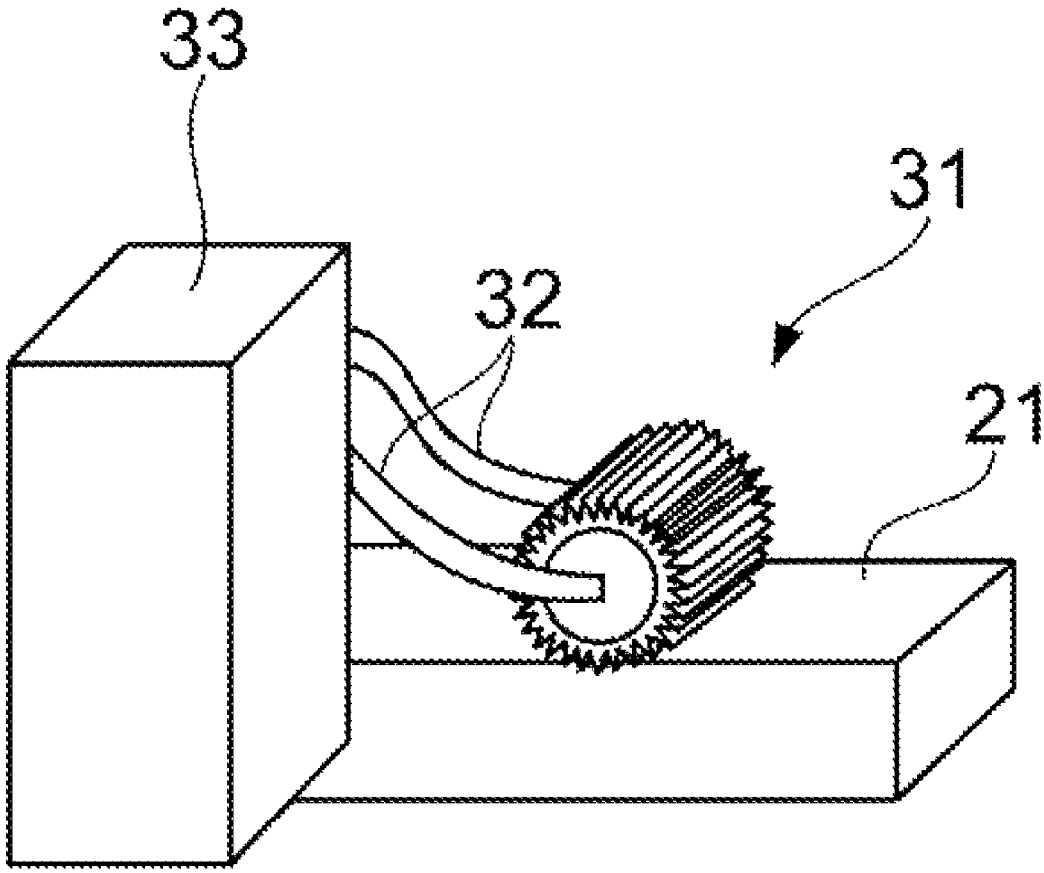
FIG. 4 is a schematic view illustrating a first embodiment of contact terminals in a card edge connector.

On the basis of the above comparative example, embodiments of the present techniques for contact terminals of a card edge connector will be described. FIG. 4 is a schematic view illustrating a first embodiment of a contact terminal in a card edge connector.

FIG. 4 illustrates a roller 31, a pair of spring members 32, and a housing 33. The roller 31 includes, on the surface thereof, radial depressions and protrusions that repeat in the direction of rotation. The roller 31 comes into contact with an advancing mating terminal 21 and rotates. The roller 31 is formed of metal, for example, beryllium copper (a copper alloy that includes 0.4 to 2.2% beryllium, cobalt, nickel, and iron as additives), and comes into contact with the mating terminal 21, thereby establishing electrical continuity therewith.

One end of each spring member 32 is supported by the housing 33, and the other end thereof rotatably supports the roller 31 from each side. The spring member 32 not only rotatably supports the roller 31 but also operates to press the roller 31 against the advancing mating terminal 21. The spring member 32 is also formed of metal to provide electrical conduction, and is in electrical continuity with the roller 31. The housing sides of the pair of spring members 32 are electrically connected through a terminal (not illustrated) to the outside of the housing 33.

As noted above, radial depressions and protrusions are formed on the surface of the roller 31. Therefore, if foreign matter such as housing flux is attached to the mating terminal 21, the roller 31 bites or punctures through the foreign matter and comes into contact with the mating terminal 21. Thus, proper contact is established, and contact failure may be prevented. In addition, because the roller 31 is used, the mating connector may be more smoothly removed or inserted even if the contact pressure is increased.

Figure 5:
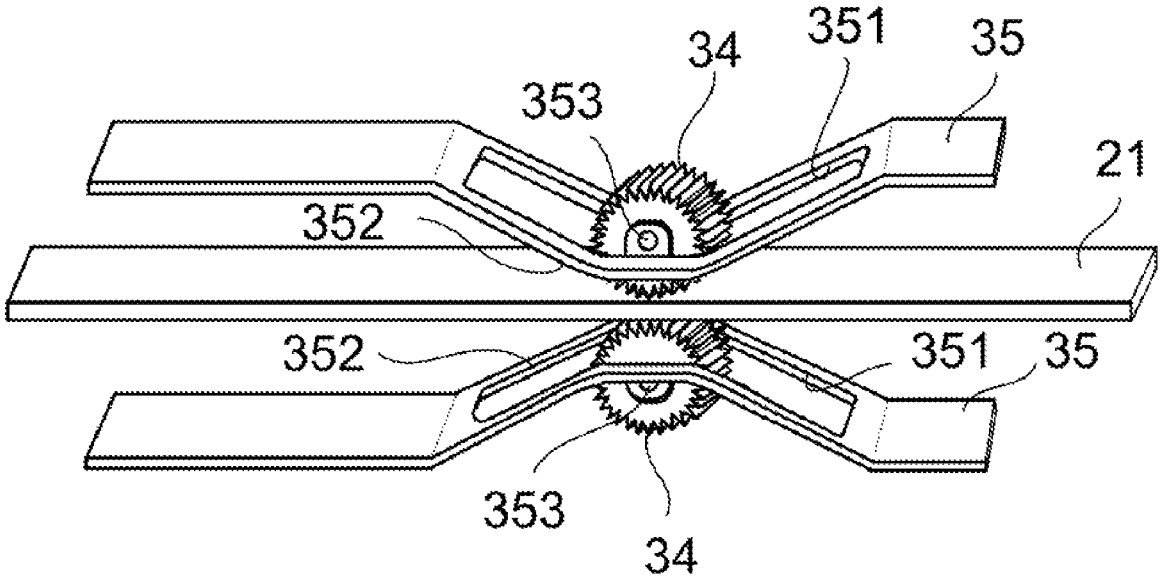
FIG. 5 is a schematic view illustrating a second embodiment of contact terminals in a card edge connector.

FIG. 5 is a schematic view illustrating a second embodiment of contact terminals in a card edge connector. FIG. 5 illustrates a pair of rollers 34 and a pair of spring members 35. Like the roller 31 illustrated in FIG. 4, each roller 34 includes, on the surface thereof, radial depressions and protrusions that extend and repeat in the direction of axis of rotation and repeat in the direction of rotation.

Each spring member 35 includes a protruding portion 352 that has an opening 351 and bents toward the mating terminal 21. The rollers 34 are disposed in the openings 351. On both sides of the openings 351 of the spring members 35, bearings 353 are formed that rotatably support the rollers 34. The spring members 35 play a role in pressing the rollers 34 against the mating terminal 21 while rotatably supporting the rollers 34. The rollers 34 are formed of metal such as beryllium copper to provide proper electrical conduction, and they come into contact with the mating terminal 21 to thereby establish electrical continuity therewith. The spring members 35 are also electrical conductors formed of metal such as copper and are in electrical continuity with the rollers 34. One end of each spring member 35 extends to the outside of the housing like the contact terminals 12 illustrated in FIG. 2.

Figure 6:
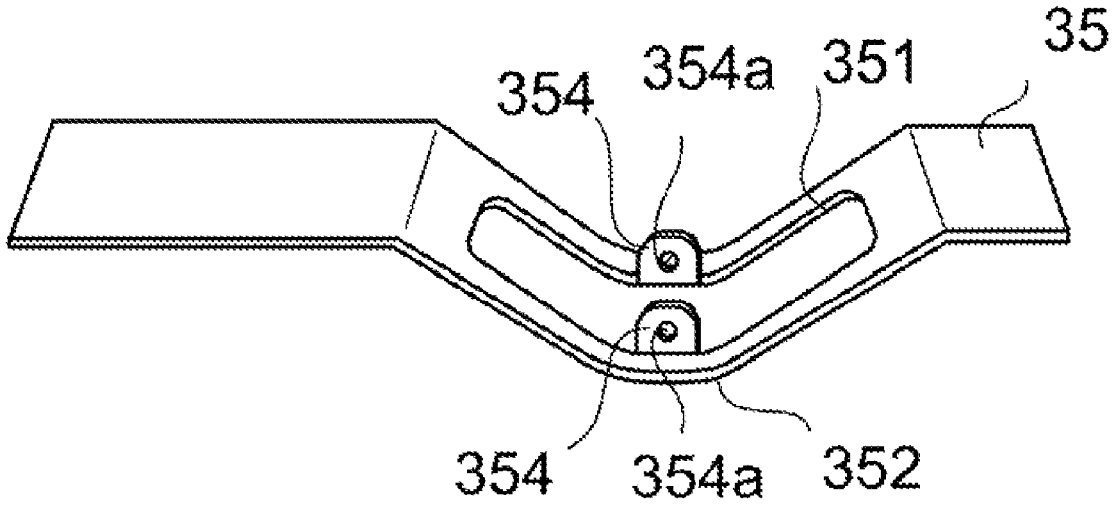
FIG. 6 illustrates an example of a spring member.

Next, each component of one of the pair of contact terminals illustrated in FIG. 5 will be described. FIG. 6 illustrates an example of a spring member 35.

The spring member 35 includes a shape such that an opening 351 is provided in a metal strip, with a protruding portion 352 formed by bending the strip toward the mating terminal side, and a pair of lugs 354 each including a hole 354*a* formed in the center thereof are provided. The pair of lugs 354 forms a bearing for the roller 34.

Figure 7A:
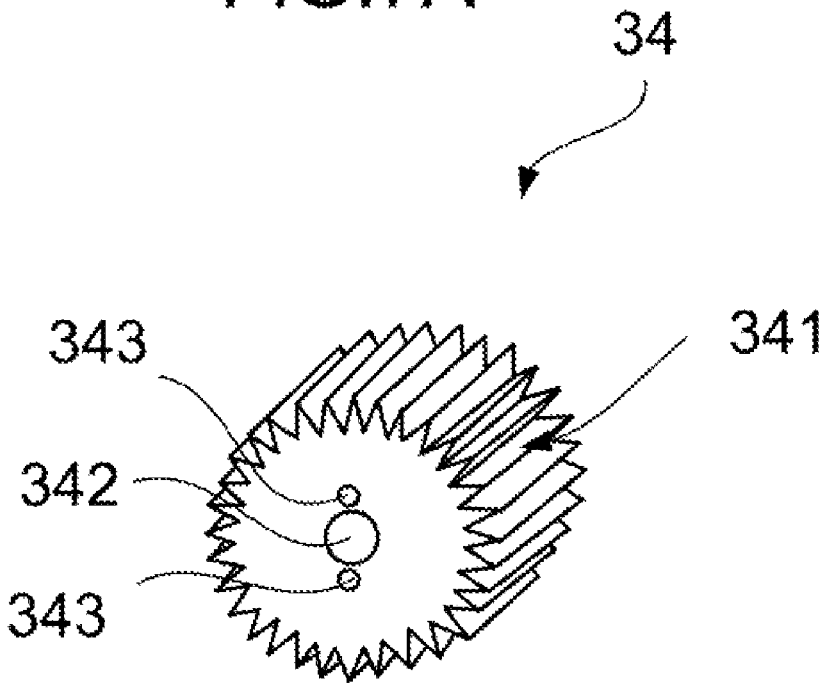
FIGS. 7A and 7B illustrate an example of a roller.
Figure 7B:
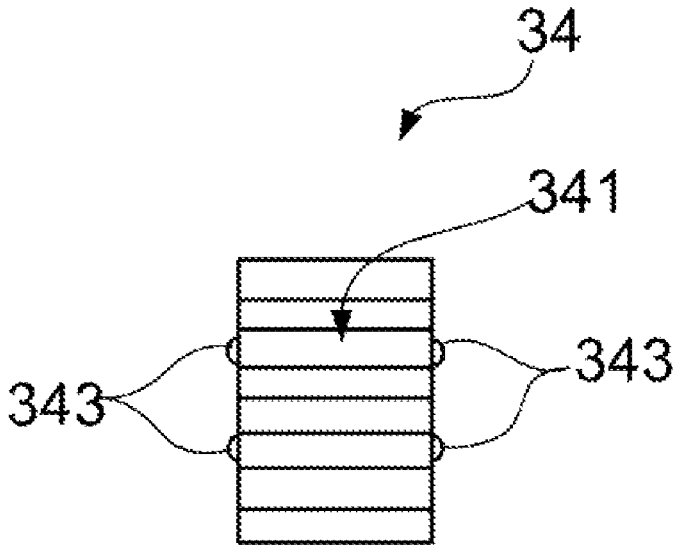

FIGS. 7A and 7B illustrate an example of a roller. FIG. 7A is providing a perspective view, and FIG. 7B providing a side view.

As described above, the roller 34 is formed, for example, of beryllium copper and includes, on the surface thereof and over the entire circumference thereof, depressions and protrusions 341 that extend in the direction of axis of rotation and repeat in the direction of rotation. A through hole 342 is formed coaxially with the axis of rotation of the roller 34. On each side of the roller 34, two protrusions 343 are formed. The protrusions 343 come into contact with the lugs 354 of the spring members 35 and ensure the electrical continuity between the roller 34 and the spring member 35.

Figure 8A:
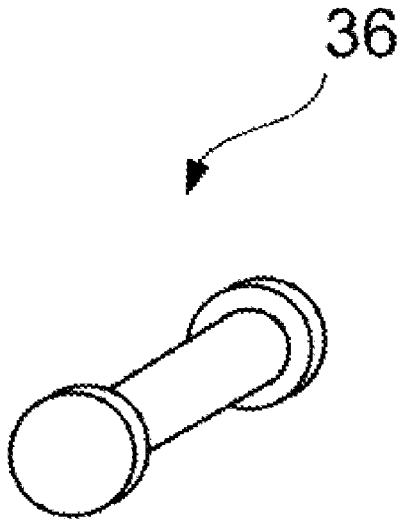
FIGS. 8A and 8B illustrate an example of an electrically-conductive shaft.
Figure 8B:
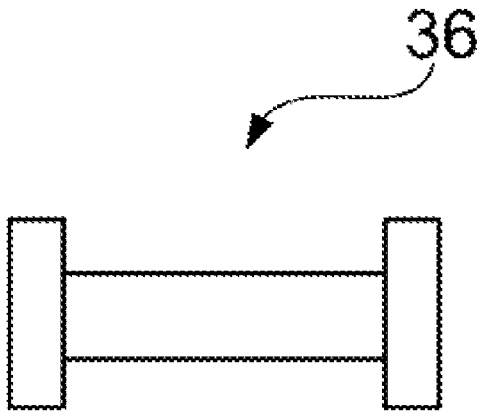

FIGS. 8A and 8B illustrate an example of an electrically-conductive shaft of the roller 34. The shaft 36 is a good conductor formed, for example, of beryllium copper. The shaft 36 is passed through the hole 354*a* of one of the pair of lugs 354 of the spring member 35 illustrated in FIG. 6, the through hole 342 (see FIG. 7) of the roller 34 disposed in the opening 351, and the hole 354*a* of the other one of the pair of lugs 354, and is plastically deformed into the shape illustrated in FIGS. 8A and 8B. Thus, the roller 34 is rotatably supported by the spring member 35, and electric continuity is established between the roller 34 and the spring member 35. As described above, the electric continuity is ensured by the contact between the protrusions 343 on both sides of the roller 34 and the lugs 354 of the spring member 35.

As described above with reference to FIGS. 6, 7A and 7B, and 8A and 8B, contact terminals including the structure illustrated in FIG. 5 are constructed. The contact terminals including this structure are disposed instead of the conventional contact terminals 12 having the shape illustrated in FIG. 3 in the housing 11 illustrated in FIGS. 1 and 2. Thus, a card edge connector as an embodiment is constructed.

The roller 34 includes, on the surface thereof, depressions and protrusions that extend in the direction of axis of rotation and repeat in the direction of rotation. However, the shape of the depressions and protrusions is not limited to this shape. The shape of the depressions and protrusions may be, for example, helicoid. Alternatively, many spot-like protrusions may be provided.

Although the roller 34 has been described, a rotating member does not have to be a roller and may be, for example, a spherical body or an ellipsoidal body.

As described above, the disclosed contact terminal and connector are advantageous in that a mating terminal may be easily removed or inserted and contact failure may be prevented.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A contact terminal for coming into electric contact with a mating terminal of a mating component, the contact terminal comprising:

a rotating member including protrusions on the surface, the rotating member rotates with an advance of the mating terminal; and a spring member that rotatably supports the rotating member and asserts the rotating member against the advancing mating terminal, wherein the spring member is a plate-like member including a protruding portion having an opening and bent toward the side of the mating terminal, and the plate-like member includes at least one bearing portion rotatably supporting the rotating member that is disposed in the opening.

2. The contact terminal according to claim 1, wherein the rotating member includes, on a sides thereof facing the at least one bearing portion, a protrusion in contact with the bearing portion.

3. A connector comprising:

a contact terminal that comes into electric contact with a mating terminal of a mating component and includes a rotating member that rotates with an advance of the mating terminal, the rotating member having protrusions on the surface, and a spring member that rotatably supports the rotating member and asserts the rotating member against the advancing mating terminal; and a housing that houses the contact terminal, receives the mating terminal and guides the mating terminal to come into contact with the rotating member, wherein the spring member is a plate-like member including a protruding portion having an opening and bent toward the side of the mating terminal, and the plate-like member includes at least one bearing portion rotatably supporting the rotating member that is disposed in the opening.

4. The connector according to claim 3, wherein the rotating member includes a protrusion in contact with the bearing portions on a sides thereof facing the at least one bearing portion.

5. A connector comprising:

a plurality of pairs of contact terminals that each holds a corresponding mating terminal of a mating component therebetween, each of the contact terminals including a rotating member that rotates with an advance of the mating terminal, each of the rotating members having protrusions on the surface, and a spring member that rotatably supports the rotating member and asserts the rotating member against the advancing mating terminal; and a housing that houses the plurality of pairs of contact terminals, receives the mating terminals and guides the mating terminals to come into electric contact with each of pairs of the rotating members, wherein each of the spring members is a plate-like member including a protruding portion having an opening and bent toward the side of the mating terminal, and the plate-like member includes at least one bearing portion rotatably supporting the rotating member that is disposed in the opening.

6. The connector according to claim 5, wherein each of the rotating members includes a protrusion in contact with the bearing portions on a sides thereof facing the at least one bearing portion.

* * * * *